US006966808B1

(12) United States Patent
Liao

(10) Patent No.: US 6,966,808 B1
(45) Date of Patent: Nov. 22, 2005

(54) POWER SURFBOARD

(76) Inventor: Chung-D Liao, 1/F., No. 28, Lane 22, Minsheng Rd., Yungho City, Taipei County (TW)

( * ) Notice: Subject to any disclaimer, the term of this patent is extended or adjusted under 35 U.S.C. 154(b) by 0 days.

(21) Appl. No.: 10/902,169

(22) Filed: Jul. 30, 2004

(51) Int. Cl.[7] ..... B63B 35/79
(52) U.S. Cl. ..... 441/74; 440/6; 114/162
(58) Field of Search ..... 441/65, 74, 79; 440/6, 38, 21–31, 13–15; 114/144 R, 162, 114/315

(56) References Cited

U.S. PATENT DOCUMENTS 2,812,736 A * 11/1957 Fry ..... 440/53
3,092,857 A * 6/1963 Churchman ..... 441/65
3,287,754 A * 11/1966 Price et al. ..... 441/74
4,028,761 A * 6/1977 Taylor ..... 441/65
5,017,166 A * 5/1991 Chang ..... 440/7
6,702,634 B2 * 3/2004 Jung ..... 441/74

* cited by examiner

*Primary Examiner*—Ed Swinehart
(74) *Attorney, Agent, or Firm*—Rosenberg, Klein & Lee

(57) ABSTRACT

A power surfboard is disclosed to include a surfboard equipped with an engine and a propeller for propelling on the sea against sea waves, a rudder pivotally provided at the bottom side of the surfboard, and a collapsible control handle coupled to the surfboard for turning by the user to bias the rudder during wave riding.

18 Claims, 8 Drawing Sheets

POWER SURFBOARD

BACKGROUND OF THE INVENTION

1. Field of the Invention

The present invention relates to a surfboard for wave riding and more particularly, to a power surfboard that is equipped with an engine and a propeller.

2. Description of the Related Art

A surfboard is a floating board specifically designed for wave riding on the sea. It is not easy to ride a surfboard on sea waves. It needs skill to ride a surfboard on a sea wave. A skillful person can ride a surfboard on a sea wave without much effort. However, it requires much effort to carry a surfboard from the beach to a certain distance in the sea, and the player becomes exhausted soon when enjoying wave riding.

SUMMARY OF THE INVENTION

The present invention has been accomplished under the circumstances in view. It is therefore the main object of the present invention to provide a power surfboard, which uses an engine and a propeller to help the user move the surfboard to a suitable location in the seat for riding sea waves. According to one embodiment of the present invention, the power surfboard comprises a surfboard equipped with an engine and a propeller for propelling on the sea against sea waves, a rudder pivotally provided at the bottom side of the surfboard, and a collapsible control handle coupled to the surfboard for turning by the user to bias the rudder during wave riding. According to an alternate form of the present invention, the power surfboard comprises a surfboard equipped with an engine and a propeller for propelling on the sea against sea waves, a rudder column pivoted to a coupling block at the bottom side of the surfboard, a rudder affixed to the rudder column, and two handles fixedly fastened to the rudder columns at two sides for operation by the user to bias the rudder column and the rudder relative to the surfboard. Further, the surfboard is provided with a safety belt that can be fastened to the user's hand or leg so that the user can quickly pull the surfboard back when fallen to the sea during a wave riding.

BRIEF DESCRIPTION OF THE DRAWINGS

FIG. 1-1 is an enlarged view of a part of FIG. 1 showing the cover mounted with a rubber packing member.

FIG. 1-2 is an enlarged view of a part of FIG. 1 showing the cover mounted with a screw.

FIG. 2 is an elevational view, partially exploded, of the power surfboard according to the first embodiment of the present invention, showing the control handle set in the operative vertical position.

FIG. 8-1 is a schematic drawing showing the connection operation between the angled coupling bar at the bow and the coupling device at the body of the power surface board.

DETAILED DESCRIPTION OF THE PREFERRED EMBODIMENT

Figures 1, 2:
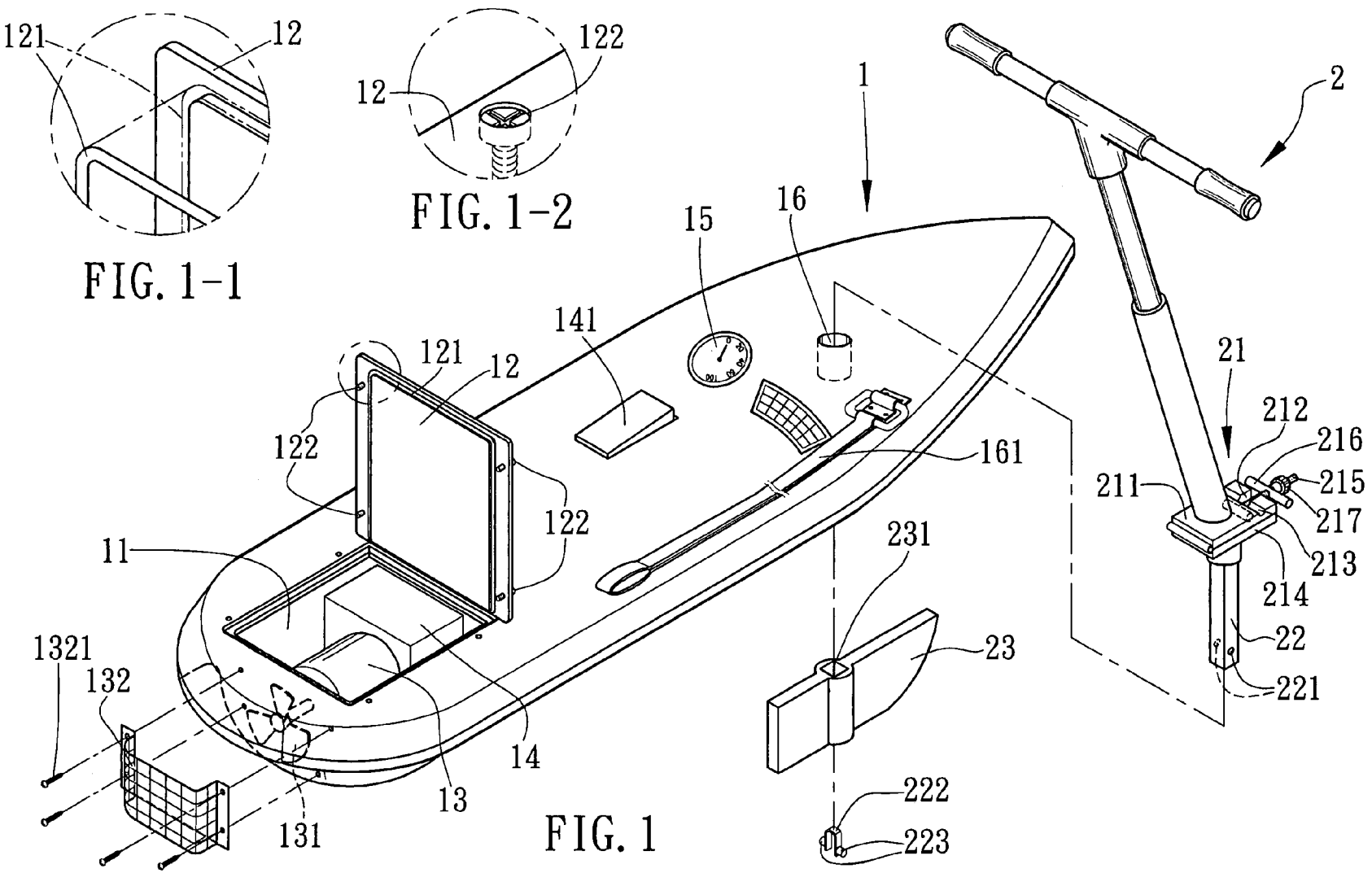
Figure 2:
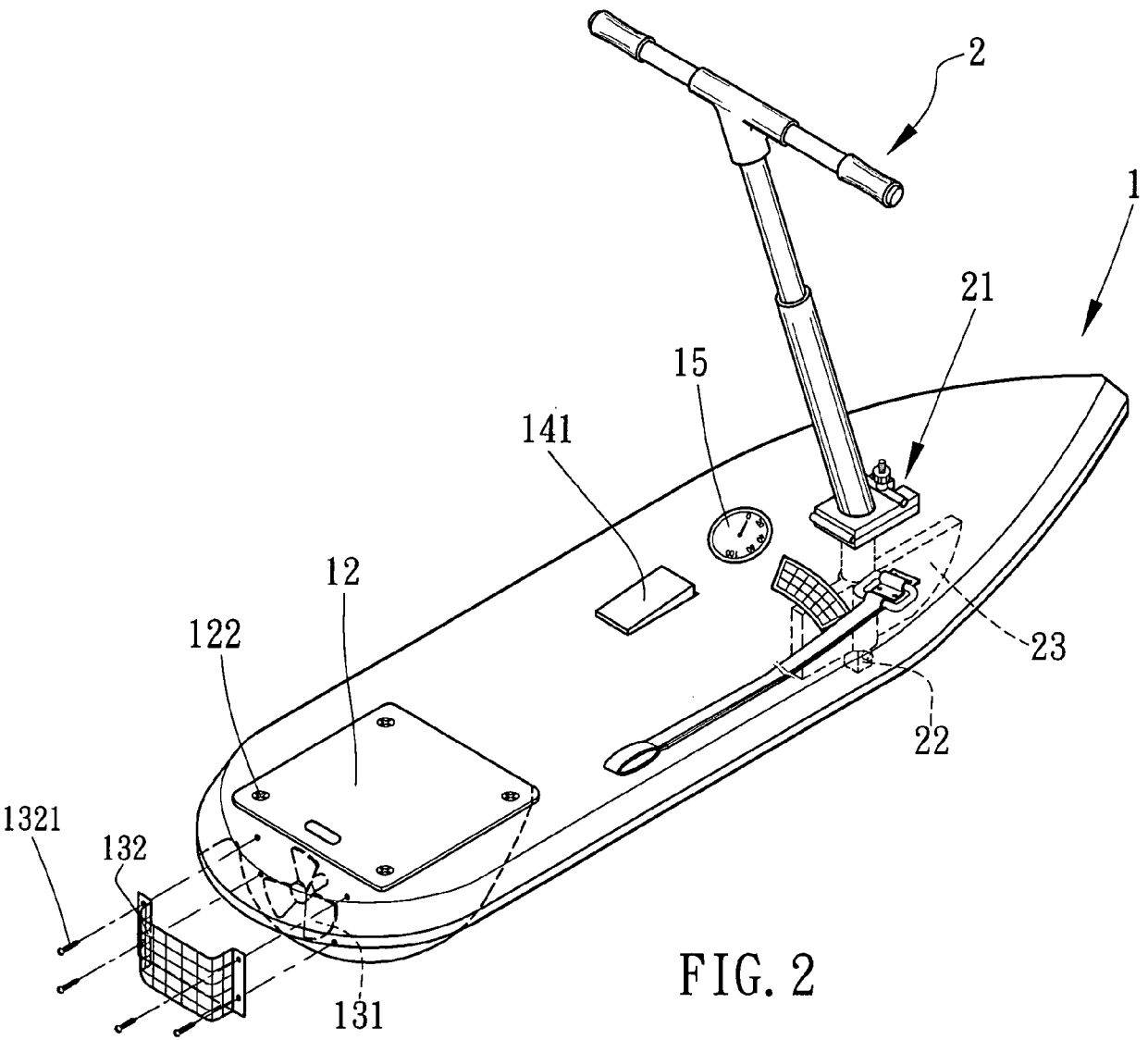
Figure 3:
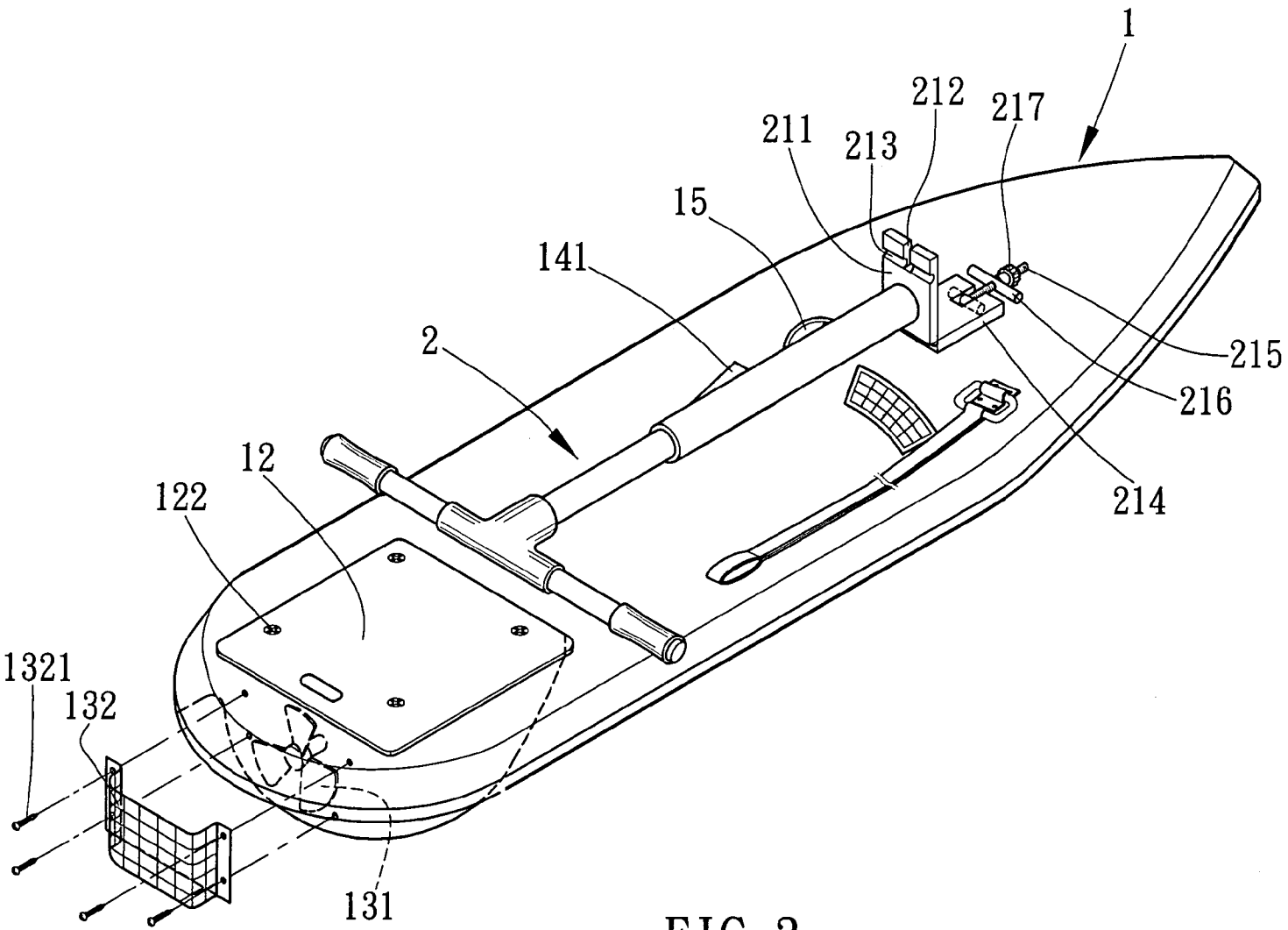
FIG. 3 is similar to FIG. 2 but showing the control handle set in the collapsed horizontal position.
Figure 4:
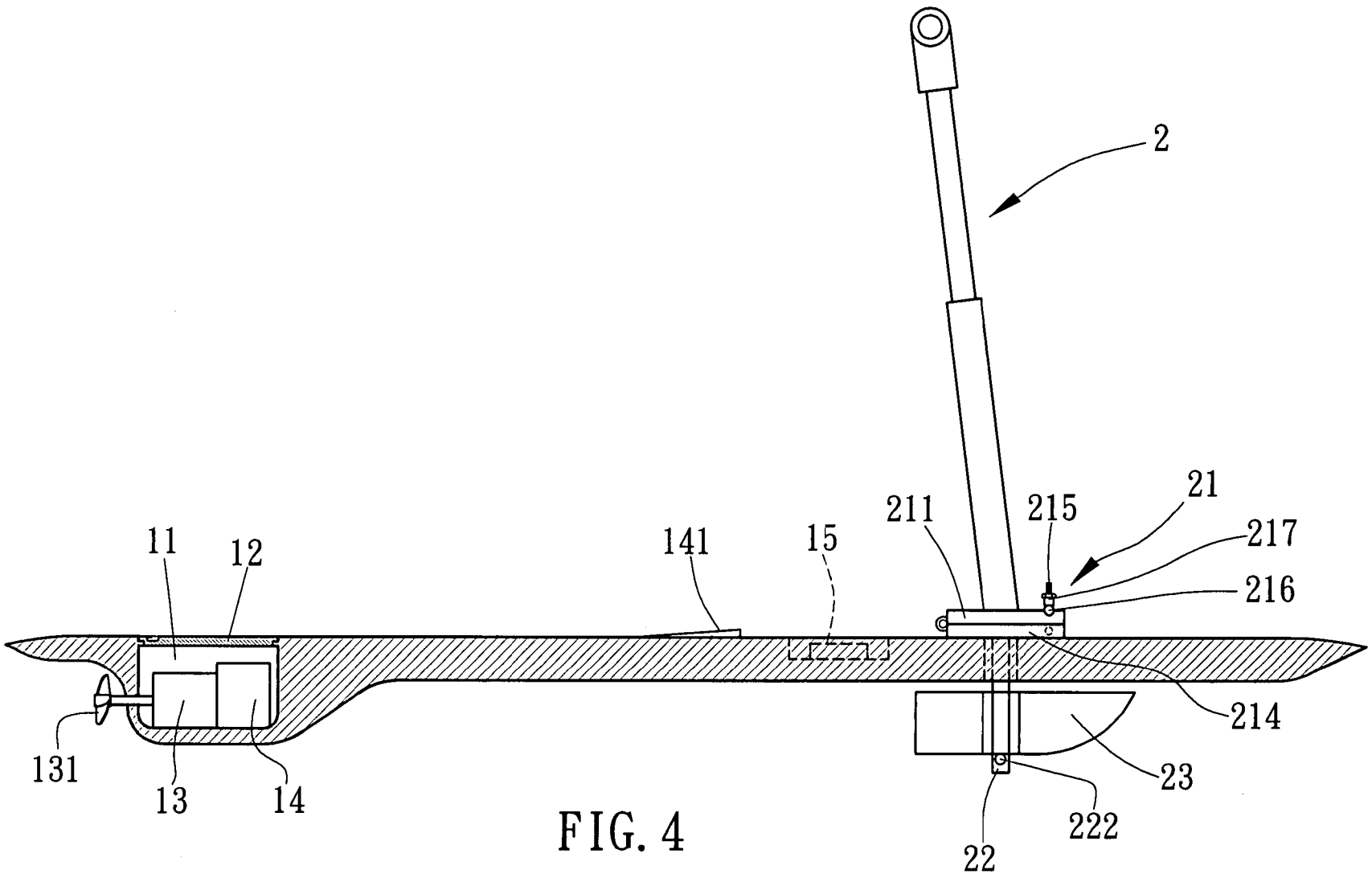
FIG. 4 is a side plain view of the power surfboard according to the first embodiment of the present invention.

Referring to FIGS. 1~4, a power surfboard 1 in accordance with the first embodiment of the present invention is shown comprising an engine 13 and a propeller 131 that are operated to propel the power surfboard 1 on the sea, enabling the user to enjoy wave riding, a rudder 23 provided at the bottom side for directing wave riding of the power surfboard 1, and a control handle 2 provided at the top side for controlling the direction of the rudder 23.

Figure 5:
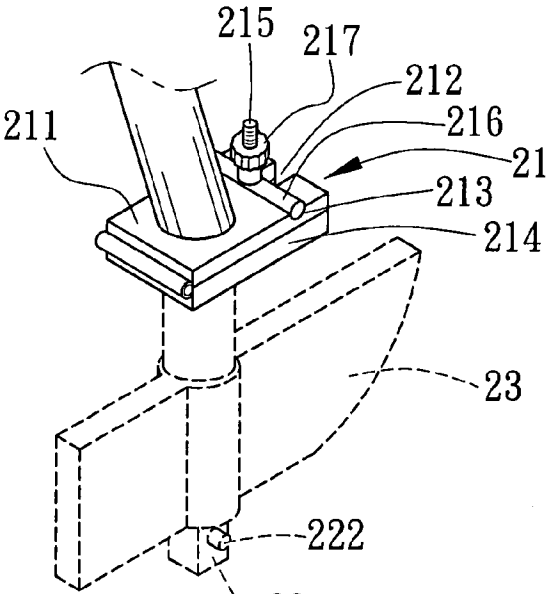
FIG. 5 is a perspective view in an enlarged scale of a part of the power surfboard according to the first embodiment of the present invention, showing the mounting arrangement of the control handle.
Figure 7:
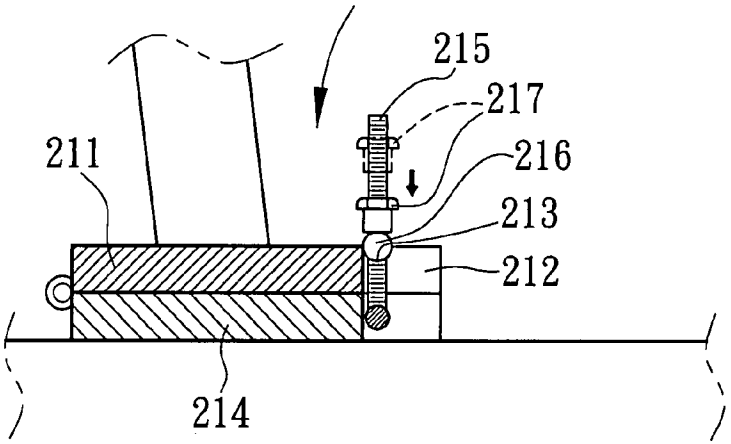
FIG. 7 is a schematic side view of a part of the power surfboard according to the first embodiment of the present invention, showing the locking operation of the hinge (II).
Figure 6:
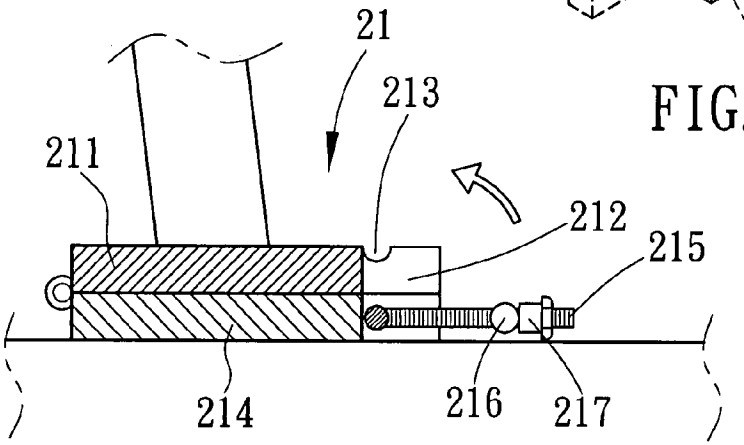
FIG. 6 is a schematic side view of a part of the power surfboard according to the first embodiment of the present invention, showing the locking operation of the hinge (I).

Referring to FIGS. 5~7 and FIGS. 1~4 again, the control handle 2 is coupled to the power surfboard 1 by a hinge 21. The hinge 21 comprises a first leaf 211, which is coupled to the control handle 2, and a second leaf 214, which is pivotally connected to the first leaf 211 and fixedly fastened to the power surfboard 1. The first leaf 211 has a peripheral notch 212 on the middle of one side edge thereof, and a transversely extended locating groove 213. The second leaf 214 has a screw rod 215 pivoted thereto. The screw rod 215 is mounted with a retaining rod 216 and a locknut 217. When in use, lift the control handle 2 from the collapsed horizontal position shown in FIG. 3 to the operative vertical position shown in FIG. 2 to close the first leaf 211 and the second leaf 214, and then lift the screw rod 215 from the horizontal position shown in FIG. 6 to the vertical position shown in FIG. 7 to engage the screw rod 215 into the peripheral notch 212 of the first leaf 211, and then rotate the locknut 217 to lower the retaining rod 216 and to engage the retaining rod 216 into the transversely extended locating groove 213, and therefore the hinge 21 is locked in the close position and the control handle 2 is locked in the operative vertical position as shown in FIGS. 2 and 5. Further, a rudder column 22 is pivotally provided at the bottom side of the second leaf 214 of the hinge 21 and inserted through a through hole 16 in the power surfboard 1 and a mounting through hole 231 of the rudder 23 and then secured to the rudder 23 by a resilient retainer 222. The resilient retainer 222 is inserted into the hollow bottom end of the rudder column 22, having two retaining portions 223 respectively engaged into respective locating holes 221 at two sides of the peripheral wall of the hollow bottom end of the rudder column 22 (see FIGS. 1, 4 and 5). The resilient retainer 222 can be removed from the rudder column 22 by forcing the retaining portions 223 inwards into the inside of the hollow bottom end of the rudder column 22. When lifted the control handle 2 to the operative vertical position, the control handle 2 is coupled to the rudder column 22, and therefore the user can turn the handle 2 to bias the rudder 23 and to further control the direction of wave riding.

Referring to FIGS. 1~7 again, the power surfboard 1 further comprises a pedal switch 141 for operation by the user's foot to switch on/off the engine 13. A meshed guard 132 is fixedly fastened to a back end of the surfboard 1 with screws 1321 to protect the propeller 131. A battery 14 is mounted inside the power surfboard 1 and electrically connected to the engine 13 through the pedal switch 141 to provide electricity to the engine 13. A battery indicator 15 is provided at the top side and adapted to indicate power level of the battery 14. The power surfboard 1 has an inside chamber 11 that accommodates the engine 13 and the battery 14. The inside chamber 11 is covered with a cover 12. The cover is sealed with a rubber packing member 121 (see FIG. 1-1) and affixed to the power surfboard 1 by screws 122 (see FIG. 1-2). The surfboard 1 further provides a safety belt 161 for fastening to the user's hand or leg during wave riding.

Figures 1, 8:
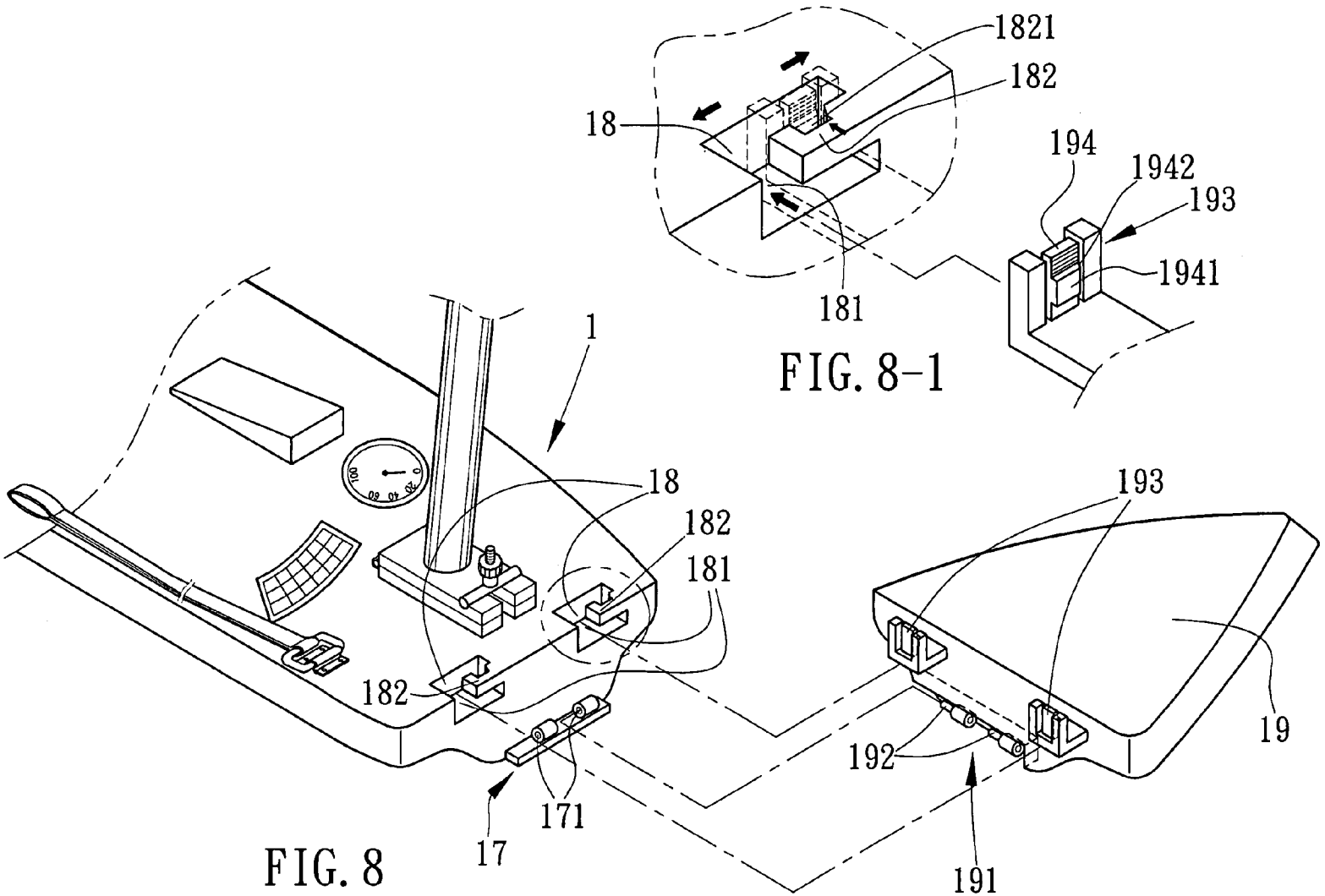
FIG. 1 is an exploded view of a power surfboard according to the first embodiment of the present invention.
FIG. 8 is an exploded view of a power surfboard according to the second embodiment of the present invention.

FIGS. 8 and 8-1 show a power surfboard according to the second embodiment of the present invention. According to this embodiment, the power surfboard 1 has a detachable bow 19. The power surfboard comprises a front hinge plate 17 transversely provided at the front side of the body thereof near the bottom, and two coupling devices 18 bilaterally disposed at the front side of the body above the front hinge plate 17. The front hinge plate 17 comprises a plurality of knuckles 171 axially aligned in a line. Each coupling device 18 comprises a receiving hole 181 and a retaining rod 182 suspended in the receiving hole 181. The retaining rod 182 has a retaining groove 1821 at the back side. The bow 19 comprises a hinge plate 191 transversely provided at the back side near the bottom, and two angled coupling bars 193 bilaterally disposed at the back side above the hinge plate 191. The hinge plate 191 comprises a plurality of pivot pins 192 respectively coupled to the knuckles 171 of the front hinge plate 17 to hinge the bow 19 to the body of the power surfboard 1. Each angled coupling bar 193 comprises a retaining spring strip 194. The retaining spring strip 194 has an engagement block 1941. The engagement block 1941 has a beveled guide face 1942. During installation, the angled coupling bars 193 of the bow 19 are respectively aimed at the coupling devices 18, and then the bow 19 is attached to the front side of the body of the power surfboard 1 to insert the angled coupling bars 193 into the receiving holes 181 of the coupling devices 18, and then move the bow 19 sideways relative to the body of the power surfboard 1 to engage the pivot pins 192 into the knuckles 171 and to force the engagement blocks 1941 of the angled coupling bars 193 into engagement with the retaining grooves 1821 of the retaining rods 182 of the coupling devices 18 respectively. By means of pushing the retaining spring strip 194 of each angled coupling bar 193 backwards to disengage the respective engagement block 1941 from the retaining groove 1821 of the retaining rod 182 of the respective coupling device 18 and then moving the bow 19 transversely relative to the body of the power surfboard 1 in the reversed direction, the bow 19 is detached from the power surfboard 1 to reduce storage space during delivery of the equipment. Because the engagement block 1941 of the retaining spring strip 194 of each angled coupling bar 193 has a beveled guide face 1942, the user can conveniently disengage the angled coupling bars 193 from the coupling devices 18.

Figure 9:
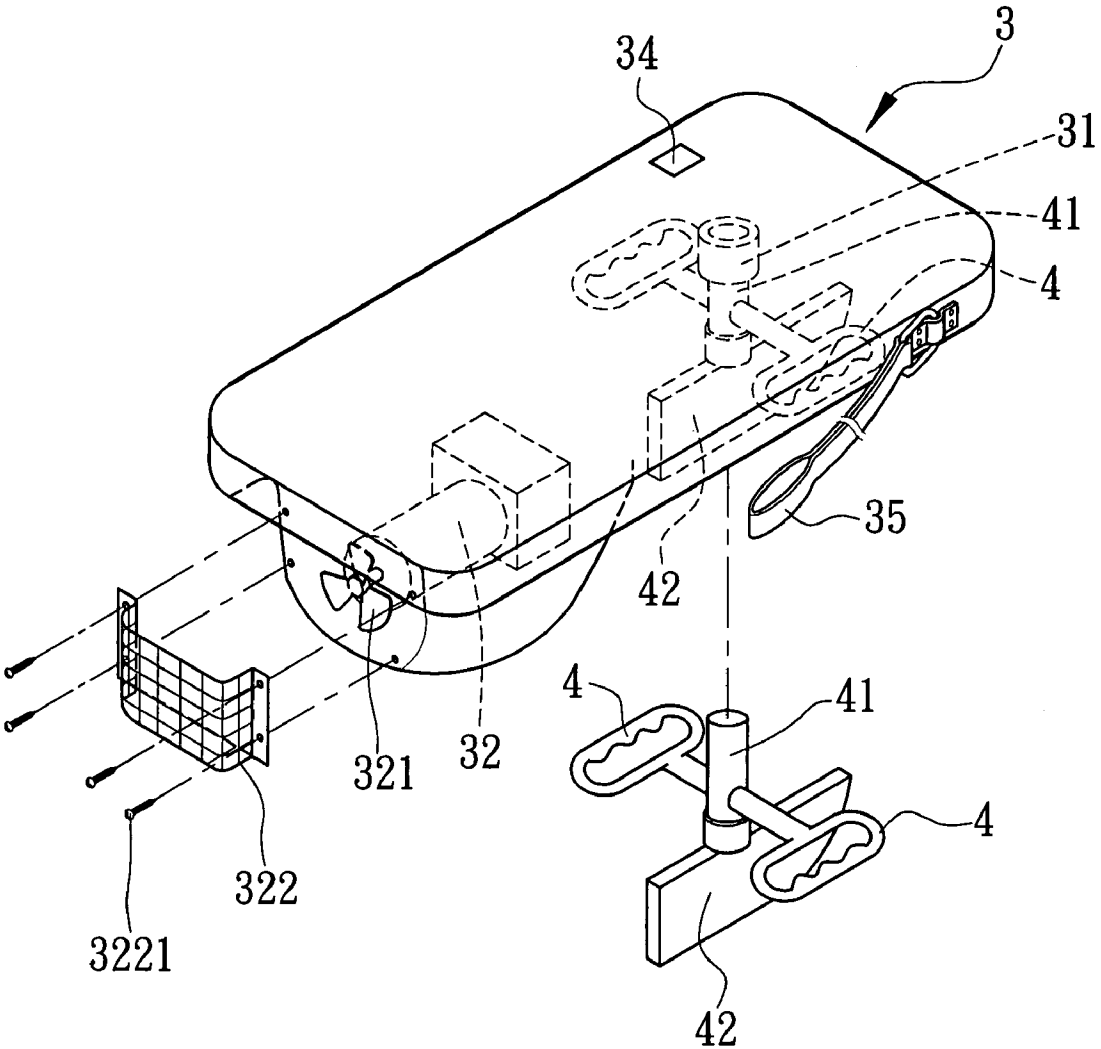
FIG. 9 is a perspective exploded view of a power surfboard according to the third embodiment of the present invention.

FIG. 9 shows a power surfboard according to the third embodiment of the present invention. According to this embodiment, the power surfboard 3 comprises a bottom coupling block 31, a rudder column 41 pivoted to the bottom coupling block 31 and holding a rudder 42, and two handles 4 respectively fastened to the rudder column 41 at two sides. When surfing, the user is lying prostrate on the power surfboard 3 with the hands holding the handles 4 to control the direction of the rudder 42. The power surfboard 3 further comprises an engine 32 and a propeller 321 for propelling the power surfboard 3 on the sea, an on/off switch 34 for controlling the operation of the engine 32, a meshed guard 322 fixedly fastened to the back end by screws 3221 to protect the propeller 321, and a safety belt 35 provided at one side for fastening to the user's hand or leg.

Figure 10:
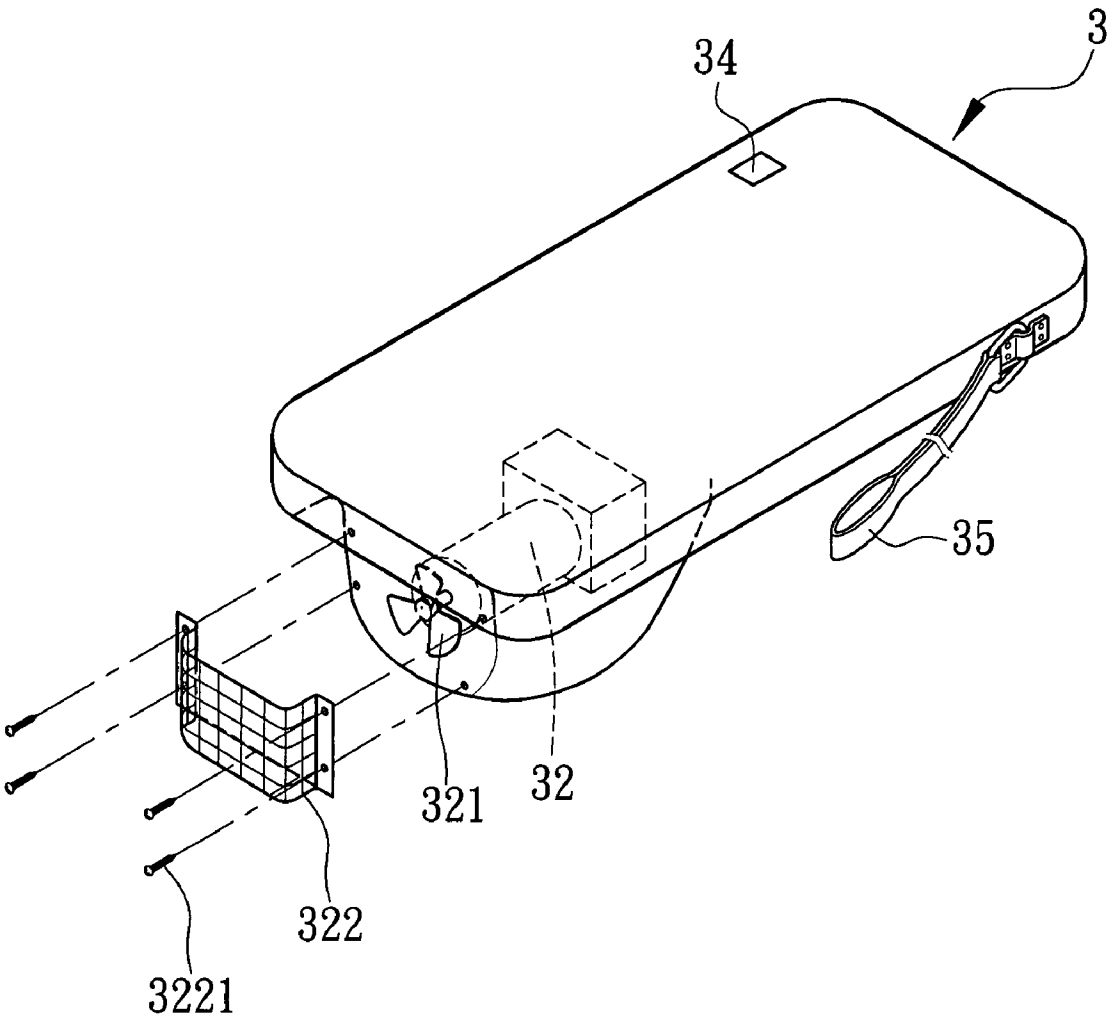
FIG. 10 is a perspective exploded view of a power surfboard according to the fourth embodiment of the present invention.

FIG. 10 shows a power surfboard according to the fourth embodiment of the present invention. This embodiment is substantially similar to the embodiment shown in FIG. 9 with the exception that the embodiment shown in FIG. 10 eliminates the aforesaid rudder column 41, rudder 42 and two handles 4.

A prototype of power surfboard has been constructed with the features of FIGS. 1~10. The power surfboard functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A power surfboard comprising:

a surfboard, said surfboard comprising an inside chamber disposed near a back end thereof and covered with a cover and sealed with a rubber packing member, and a vertical through hole near a front end thereof;

a propeller provided outside said surfboard and adapted to propel said surfboard on water;

an engine mounted in said inside chamber inside said surfboard and adapted to rotate said propeller;

a rudder column pivotally provided at a bottom side of said surfboard;

a rudder fastened to said rudder column; and a control handle provided at a top side of said surfboard and coupled to said rudder column for turning said rudder column and said rudder by the user.

2. The power surfboard as claimed in claim 1, further comprising a hinge installed in said surfboard and coupled between said control handle and said rudder column and turnable between an open position to hold said control handle in a non-operative horizontal position and a close position to hold said control handle in an operative vertical position, and lock means adapted to lock said hinge in said close position, said hinge comprising a first hinge leaf coupled to said control handle and a second hinge leaf coupled to said rudder column and fixedly fastened to said surfboard, said first hinge leaf having a peripheral notch and a transversely extended locating groove, said lock means comprising a screw rod pivoted to said second hinge leaf and movable in and out of the peripheral notch of said first hinge leaf, a retaining rod coupled to said screw rod and movable along said screw rod for engaging into said transversely extended locating groove of said first hinge leaf, and a locknut threaded onto said screw rod and adapted to lock said retaining rod to said transversely extended locating groove of said first hinge leaf.

3. The power surfboard as claimed in claim 1, further comprising a pedal switch mounted in said surfboard and adapted to switch on/off said engine.

4. The power surfboard as claimed in claim 1, wherein said rudder has a vertically extended mounting through hole detachably fastened to said rudder column; said rudder column is inserted through the vertically extended mounting through hole of said rudder and affixed thereto by a resilient retainer, said rudder column having two locating holes at two sides of the periphery of a hollow bottom end thereof, said resilient retainer being inserted into the hollow bottom end of said rudder column and having two retaining portions respectively engaged into the locating holes of said rudder column.

5. The power surfboard as claimed in claim 1, further comprising a battery mounted in said inside chamber inside said surfboard and electrically connected to said engine to provide electricity to said engine.

6. The power surfboard as claimed in claim 5, further comprising a batter power indicator adapted to indicate the power level of said battery.

7. The power surfboard as claimed in claim 1, further comprising a safety belt fixedly connected to said surfboard for fastening to a part of the user's body.

8. The power surfboard as claimed in claim 1, further comprising a meshed guard fixedly fastened to said surfboard with screws to protect said propeller.

9. A power surfboard comprising:

a surfboard, said surfboard comprising a body, a bow detachably fastened to said body at a front side, and a coupling structure for securing said bow to said body, said coupling structure further including, a first hinge plate fixedly provided at the front end of said body at a bottom side, said first hinge plate comprising a plurality of knuckles, at least one coupling hole provided above said first hinge plate, at least one retaining rod respectively suspended in said at least one retaining rod respectively suspended in said at least one coupling hole, said at least one retaining rod each having a retaining groove at a back side thereof, a second hinge plate fixedly provided at a rear end of said bow at a bottom side, and, at least one angled coupling bar respectively provided at said bow above said second hinge plate for coupling to the retaining rod in each said coupling hole, said second hinge plate having a plurality of pivot pins for coupling to said knuckles of said first hinge plate, said at least one angled retaining bar each having a retaining spring strip, said retaining spring strip having a retaining block for engaging the retaining groove at the back side of one said retaining rod, said body comprising an inside chamber disposed near a back end thereof and covered with a cover and sealed with a rubber packing member, and a vertical through hole near front end thereof;

a propeller provided outside said surfboard and adapted to propel said surfboard on water;

an engine mounted in said inside chamber inside said surfboard and adapted to rotate said propeller;

a rudder column pivotally provided at a bottom side of said surfboard;

a rudder fastened to said rudder column; and a control handle provided at a top side of said surfboard and coupled to said rudder column for turning said rudder column and said rudder by the user.

10. The power surfboard as claimed in claim 9, further comprising a pedal switch mounted in said surfboard and adapted to switch on/off said engine.

11. The power surfboard as claimed in claim 9, further comprising a safety belt fixedly connected to said surfboard for fastening to a part of the user's body.

12. The power surfboard as claimed in claim 9, further comprising a meshed guard fixedly fastened to said surfboard with screws to protect said propeller.

13. A power surfboard comprising:

a surfboard, said surfboard comprising a body, a bow detachably fastened to said body at a front side, and a coupling structure for securing said bow to said body, said body comprising an inside chamber disposed near a back end thereof and covered with a cover and sealed with a rubber packing member, and a vertical through hole near front end thereof;

a propeller provided outside said surfboard and adapted to propel said surfboard on water;

an engine mounted in said inside chamber inside said surfboard and adapted to rotate said propeller;

a rudder column pivotally provided at a bottom side of said surfboard;

a rudder fastened to said rudder column;

a control handle provided at a top side of said surfboard and coupled to said rudder column for turning said rudder column and said rudder by the user; and a hinge installed in said surfboard and coupled between said control handle and said rudder column and turnable between an open position to hold said control handle in a non-operative horizontal position and a close position to hold said control handle in an operative vertical position, and lock means adapted to lock said hinge in said close position, said hinge comprising a first hinge leaf coupled to said control handle and a second hinge leaf coupled to said rudder column and fixedly fastened to said surfboard, said first hinge leaf having a peripheral notch and a transversely extended locating groove, said lock means comprising a screw rod pivoted to said second hinge leaf and movable in and out of the peripheral notch of said first hinge leaf, a retaining rod coupled to said screw rod and movable along said screw rod for engaging into said transversely extended locating groove of said first hinge leaf, and a locknut threaded onto said screw rod and adapted to lock said retaining rod to said transversely extended locating groove of said first hinge leaf.

14. A power surfboard comprising:

a surfboard, said surfboard comprising a body, a bow detachably fastened to said body at a front side, and a coupling structure for securing said bow to said body, said body comprising an inside chamber disposed near a back end thereof and covered with a cover and sealed with a rubber packing member, and a vertical through hole near a front end thereof;

a propeller provided outside said surfboard and adapted to propel said surfboard on water;

an engine mounted in said inside chamber inside said surfboard and adapted to rotate said propeller;

a rudder column pivotally provided at a bottom side of said surfboard;

a control handle provided at a top side of said surfboard and coupled to said rudder column for turning said rudder column and said rudder by the user;

a rudder fastened to said rudder column, wherein said rudder has a vertically extended mounting through hole detachably fastened to said rudder column; said rudder column is inserted through the vertically extended mounting through hole of said rudder and affixed thereto by a resilient retainer, said rudder column having two locating holes at two sides of the periphery of a hollow bottom end thereof, said resilient retainer being inserted into the hollow bottom end of said rudder column and having two retaining portions respectively engaged into the locating holes of said rudder column.

15. A power surfboard for riding on water comprising:

a surfboard, said surfboard having a bottom coupling block, said bottom coupling block located on a bottom surface of said surfboard extending below a water line of said water;

a rudder column pivoted to said bottom coupling block of said surfboard;

a rudder affixed to said rudder column; and a pair of handles fixedly coupled to said rudder column at two sides for operation by a user, said handles being located below the water line for permitting said user to bias said rudder column and said rudder relative to said surfboard, whereby said user lies prostrate on said top side of said surfboard and manipulates said handles below said water line.

16. The power surfboard as claimed in claim 15, further comprising a propeller provided outside said surfboard and adapted to propel said surfboard on water and an engine mounted inside said surfboard and adapted to rotate said propeller.

17. The power surfboard as claimed in claim 15, further comprising a safety belt connected to said surfboard for fastening to a part of the user's body.

18. The power surfboard as claimed in claim 16, further comprising a meshed guard fixedly fastened to said surfboard with screws to protect said propeller.

* * * * *